United States Patent [19]

Takahara et al.

[11] 4,285,317

[45] Aug. 25, 1981

[54] EXHAUST GAS RECIRCULATION SYSTEM

[75] Inventors: Yasuo Takahara, Oobu; Shigeo Hayashi, Okazaki; Shizuo Yamada, Kariya; Norio Shibata, Susono, all of Japan

[73] Assignees: Nippondenso Co., Ltd.; Toyota Jidosha Kogyo Kabushiki Kaisha

[21] Appl. No.: 105,119

[22] Filed: Dec. 19, 1979

[30] Foreign Application Priority Data

Apr. 13, 1978 [JP] Japan ..... 53-49124

[51] Int. Cl.[3] ..... F02M 25/06

[52] U.S. Cl. ..... 123/568

[58] Field of Search ..... 123/568, 571

[56] References Cited

U.S. PATENT DOCUMENTS

| | | | |
|---|---|---|---|
| 4,031,871 | 6/1977 | Hamanishi | 123/568 |
| 4,116,182 | 9/1978 | Bradshaw | 123/568 |
| 4,180,035 | 12/1979 | Saiki et al. | 123/568 |
| 4,186,702 | 2/1980 | Day et al. | 123/568 |
| 4,196,706 | 4/1980 | Kohama et al. | 123/568 |
| 4,205,644 | 6/1980 | Treadwell et al. | 123/568 |
| 4,224,909 | 9/1980 | Toyama et al. | 123/568 |
| 4,230,079 | 10/1980 | Kohama et al. | 123/568 |

FOREIGN PATENT DOCUMENTS

| | | | |
|---|---|---|---|
| 2318917 | 10/1974 | Fed. Rep. of Germany | 123/568 |
| 54-135928 | 10/1979 | Japan | 123/568 |

*Primary Examiner*—Wendell E. Burns

*Attorney, Agent, or Firm*—Cushman, Darby & Cushman

[57] ABSTRACT

An exhaust gas recirculation system for an internal combustion engine in which an exhaust gas control valve and a pressure regulating valve is constructed as one body to facilitate the mounting of the system on the engine and to improve the response characteristic of the system. Also, the chamber of the pressure regulating valve opposite to the chamber for receiving the exhaust gas is subjected to a pressure which is controlled in corresponding to the state of engine operation such as load, engine speed or the like, so that the rate of the exhaust gas recirculation is controlled in accordance with the state of engine operation.

4 Claims, 2 Drawing Figures

EXHAUST GAS RECIRCULATION SYSTEM

BACKGROUND OF THE INVENTION

The present invention relates to an exhaust gas recirculation system for automobile engine and adapted to suppress the production of nitrogen oxides (NOx).

To cope with the current tendency of tightening of exhaust emission controlling regulations, it has become necessary to control the rate of the exhaust gas recirculation in automobile engines more precisely and in good response to the state of operation of the engine.

Also, there is an increasing demand for an easier and convenient mounting of the exhaust gas cleaning device, in view of the trend of complication of construction of the exhaust has cleaning device.

Conventional exhaust gas recirculation system having a separate exhaust gas control valve and a regulation valve which are mounted separately has various drawbacks or problems. For instance, a delay of signal transmission is inevitable due to the presence of a pipe connecting the exhaust gas control valve and the pressure regulating valve which are mounted separately. In addition, the conventional system is difficult to install on the automobile engine, because of a too large number of parts. Further, the conventional exhaust gas recirculation system could hardly provide a correction of the rate of exhaust gas recirculation in response to the state of engine operation, e.g. the level of load, although it can maintain a constant ratio of the rate of exhaust gas recirculation to the flow rate of the intake air.

SUMMARY OF THE INVENTION

It is, therefore, a major object of the invention to provide an exhaust gas recirculation system having an exhaust gas control valve and a pressure regulating valve which are constructed as a unit, thereby to facilitate the mounting of the system on the automobile engine and, at the same time, to improve the response characteristic of the system. Particularly, the invention aims at providing an exhaust gas recirculation system having an exhaust gas control valve and a pressure regulating valve in which the chamber of the pressure regulating valve opposite to the chamber to which the exhaust gas is introduced is subjected to a pressure which is controlled in accordance with the state of the engine operation, so that the rate of the exhaust gas recirculation is corrected in accordance with the state of the engine operation.

It is another object of the invention to provide an exhaust gas recirculation system in which a fourth diaphragm chamber adapted to receive the pressure corresponding to the engine operation is provided in a side-by-side relation to a third diaphragm chamber, such that the pressure is introduced into the third diaphragm chamber through the fourth diaphragm chamber, whereby a large fluctuation of the pressure in the third diaphragm chamber is fairly avoided.

It is still another object of the invention to provide an exhaust gas recirculation system having a simplified and light-weight construction of the third and fourth diaphragm chambers, as well as an improved response characteristic and a high reliability.

The above and other objects, as well as advantageous features of the invention will become more clear from the following description of the preferred embodiments taken in conjunction with the accompanying drawings.

DESCRIPTION OF THE PREFERRED EMBODIMENTS OF THE INVENTION

Figure 1:
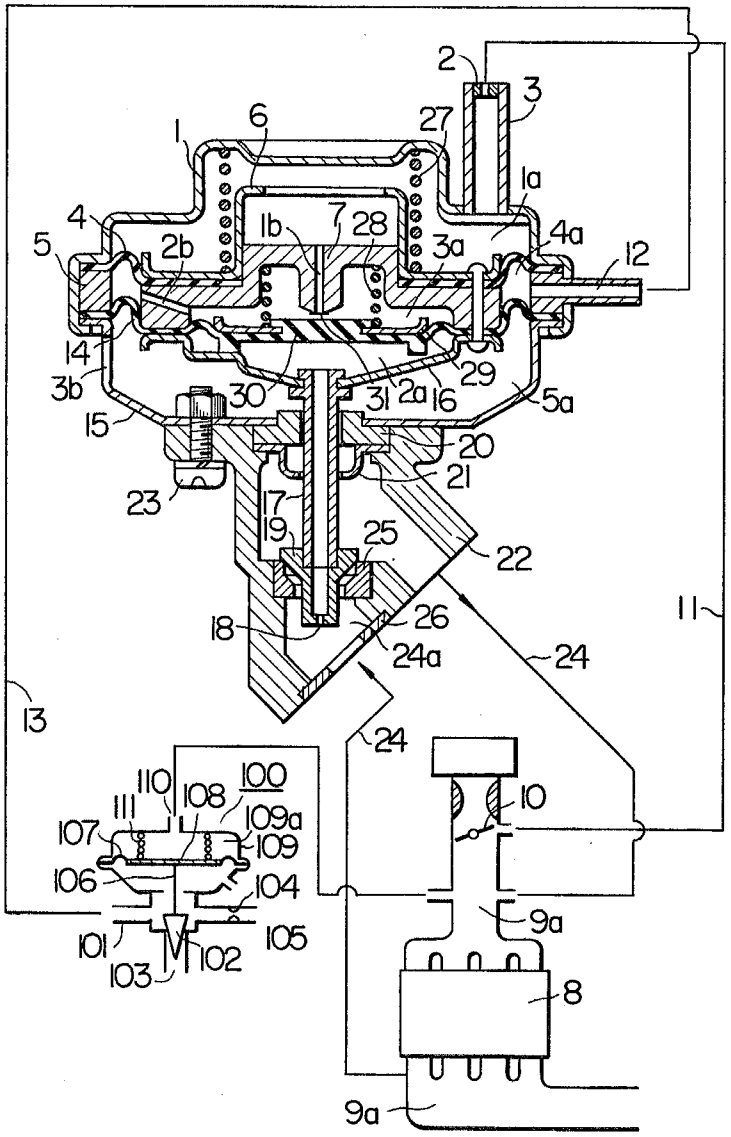
FIG. 1 is a schematic illustration of an exhaust gas recirculation system which is an embodiment of the invention.

Referring first to FIG. 1 showing a first embodiment of the invention, a pressure introduction pipe 3 having an orifice 2 is fixed to a cover 1. A diaphragm generally designated at a reference numeral 4 is clamped at its peripheral portion between the cover 1 and a first case 5. A first plate 6 and a first inner case 7 are attached to the central portion of the diaphragm 4.

The pressure introduction pipe 3 is communicated, through a pressure pickup tube 11, with such portion of the intake pipe **9*a* of an internal combustion engine 8** near the throttle valve as being positioned just upstream from the throttle valve when the latter is closed.

The first case 5 has a pressure introduction pipe 12 and is communicated through a pressure pickup pipe 13 with an output port 101 of the pressure control valve 100 which operates in accordance with the load.

A reference numeral 14 denotes a second diaphragm which is clamped at its peripheral portion by the first case 5 and a second case 15. The first inner case 7 and a second inner case 16 are attached to the central portion of the second diaphragm 14. An atmospheric chamber **5*a* defined by the second diaphragm 14, second case 15 and the second inner case 16 is opened to the atmosphere through an atmospheric port 3*b***.

The cover 1, first inner case 7 and the first diaphragm 4 in combination constitute a first diaphragm chamber **1*a*, while a second diaphragm chamber 2*a* is defined by the second diaphragm 14 and the second inner case 16. Further, a third diaphragm chamber is formed by the first inner case 7 and the second diaphragm 14. Finally, a fourth diaphragm chamber 4*a* is constituted by the first diaphragm 4, second diaphragm 14, first case 5 and the first inner case 7**.

A reference numeral 17 denotes a hollow shaft which is attached to the second inner case 16. A hollow valve 19 having an orifice 18 is attached to the end of the hollow shaft 17.

The second case 16 is fixed to a housing 22, together with the bearing 20 for the shaft 17 and a heat insulating plate 21, by means of bolts 23 inserted through the housing 22.

The housing 22 constitutes a part of an exhaust gas recirculation passage 24 between the exhaust pipe **9*b* and the intake pipe 9*a*, and is provided at its inside with two restricting members 25, 26. The restricting member 25 disposed at the downstream side, i.e. closer to the exhaust pipe 9*b*, functions as a valve seat which is adapted to cooperate with the valve 19 attached to the lower end of the hollow shaft 17 thereby to open and close the exhaust gas recirculation passage 24**.

The pair of restricting members 25, 26 cooperate with each other in defining therebetween an exhaust pressure controlling chamber 24.

The first plate 6 and associated members are biased downwardly by means of a spring 27 disposed in the first diaphragm chamber **1*a*. Similarly, a second plate 29 attached to the center of the diaphragm 14 is biased downwardly, together with the second diaphragm 14, by means of a spring 28 which is disposed in the third diaphragm chamber 3***a*.

A valve portion 30 formed at the central portion of the second diaphragm 14 is normally positioned away from a valve seat 31 formed on the first inner case 7, so that a pressure transmission passage 1*b* formed in the center of the first inner cast 7 provides a communication between the first diaphragm chamber 1*a* and the third diaphragm chamber 3*a*.

Further, the third and the fourth diaphragm chambers 3*a* and 4*a* are communicated with each other through a pressure transmitting passage 2*b* formed in the first inner case 7.

A pressure control valve 100 has an output port 101, an atmospheric port 103 the opening area of which is varied by a valve member 102, and another atmospheric port 105 provided with an orifice. A valve body 102 is fixed to the diaphragm 107 and the plate 108 through the shaft 106. A reference numeral 109 denotes a cover which is fixedly provided with a pressure introducing port 110. The cover 109 defines a pressure chamber 109*a* in cooperation with a diaphragm 107. The pressure chamber 109*a* accommodates a spring 111 which biases the plate 108 downwardly.

An intake pressure established around the throttle valve 10 is introduced to the first diaphragm chamber 1*a*, while the second diaphragm chamber 2*a* receives the pressure in the exhaust pressure controlling chamber 24*a*. Further, the pressure generated in the portion of the exhaust pipe 9*a* downstream from the throttle valve 10.

The exhaust gas recirculation system of the invention having the described construction operates in a manner explained hereinunder.

The system operates in the same manner as the known exhaust gas recirculation system of back-pressure controlling type, when the third diaphragm chamber 3*a* is opened to the atmosphere. Namely, the mean pressure in the exhaust pressure controlling chamber 24*a* is substantially equal to the mean pressure in the third diaphragm chamber 3*a*. In this state, the rate Q of the exhaust gas recirculation is affected by the pressure Pe in the exhaust side and the pressure Pc in the exhaust pressure controlling chamber 24*a*, rather than by the restricting member 26 in the exhaust gas recirculation passage 24. More specifically, the rate Q of exhaust gas recirculation is expressed as $Q \propto \sqrt{Pe-Pc}$. Since the pressure Pe is related to the flow rate of the intake air, the exhaust gas recirculation rate (EGR ratio), i.e. the ratio of the rate of exhaust gas recirculation to the flow rate of the intake air supplied to the engine 8, is maintained constant as is well known to those skilled in the art.

However, according to the invention, it is possible to control the EGR rate in relation to the load, as will be understood from the following description. Namely, the engine boost introduced to the pressure chamber 109*a* of the pressure control valve 100 is decreased as the load applied to the engine is increased, so that the spring 111 biases the valve 102 downwardly overcoming the force of the vacuum in the pressure chamber 109*a*, thereby to close the atmospheric port 103 or to reduce the opening area of the latter. In consequence, the flow rate of the air introduced through the atmospheric port 103, atmospheric port 105 and fourth diaphragm chamber 4*a* to the third diagphragm chamber 3*a* is decreased.

To the contrary, as the load is decreased, the pressure introduced into the pressure chamber 109*a* is increased so that the valve 102 is moved upward as viewed in the drawings thereby to increase the opening area of the atmospheric port 103 to increase the flow rate of the air which is introduced into the third atmospheric chamber 3*a* through the atmospheric ports 103 and 105.

As the air introduced into the third atmospheric chamber 3*a* is decreased, a vacuum remains in the third diaphragm chamber 3*a*. The level of this vacuum becomes higher as the rate of introduction of the atmospheric air is decreased. In the described embodiment, however, a setting is made such that this vacuum is several mmHg at the highest.

The above-explained operation of the pressure control valve 100 causes the vacuum in the third diaphragm chamber 3*a* to increase as the level of the load is increased. Since the mean pressure Pc in the exhaust pressure controlling chamber 24 is substantially equal to the mean pressure in the third diaphragm chamber 3*a*, the negative pressure Pc in the exhaust pressure controlling chamber 24*a* is increased as the load applied to the engine is increased.

As explained before in connection with the expression $Q \propto \sqrt{Pe-Pc}$, the EGR ratio is maintained constant as a constant pressure Pc is maintained. Therefore, the EGR ratio is increased as the pressure Pc is increased in accordance with the increase of the load. The atmospheric port 105 formed in the pressure control valve 100 and provided with the orifice 104 is provided for preventing a large fluctuation of the pressure in the third diaphragm chamber 3*a* which is liable to be caused by the influence of the atmosphere into the third diaphragm 3*a* through the atmospheric port 103. In fact, the rate of exhaust gas recirculation can be controlled sufficiently even by a small pressure change in the third diaphragm chamber 3*a*.

Figure 2:
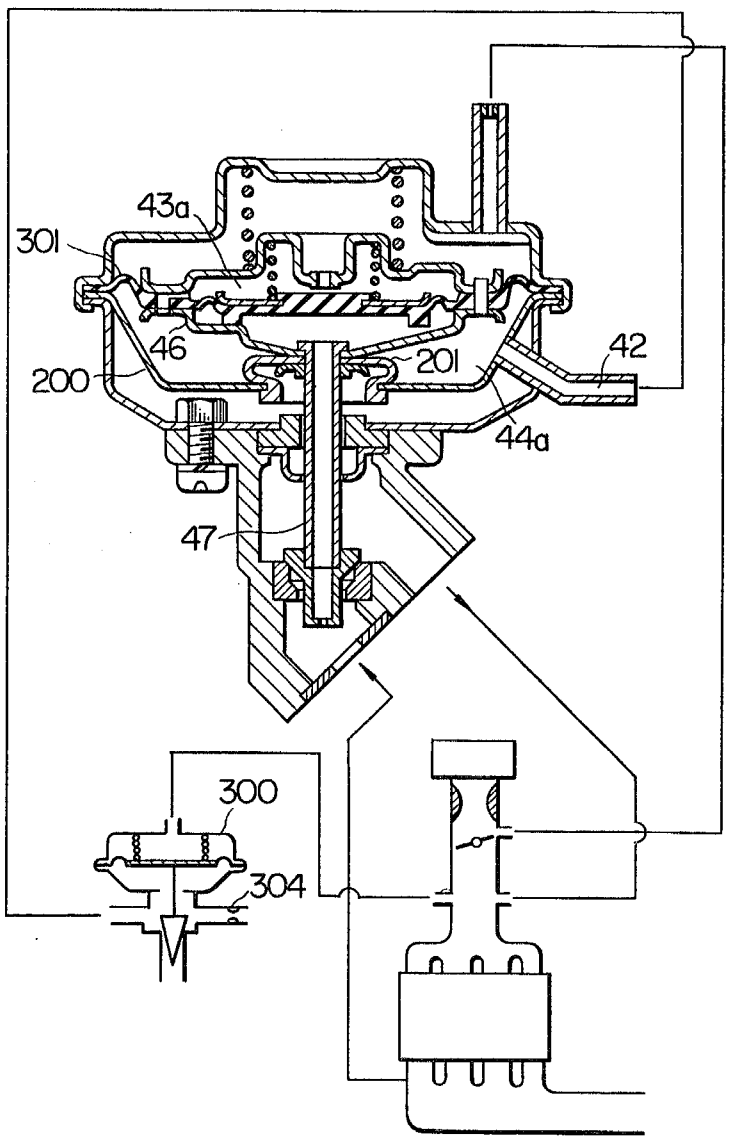
FIG. 2 is a schematic illustration of an exhaust gas recirculation system which is another embodiment of the invention.

FIG. 2 shows another embodiment of the invention. This embodiment differs from the first embodiment in the points specifically mentioned below. Namely, in this embodiment, a sole diaphragm designated by a reference numeral 301 is used. Also, the first plate 6 of the first embodiment is substituted by a third inner case 200 and bellows 201. Further, a pressure introducing pipe 42 is attached to the third inner case 200. A fourth diaphragm chamber 44*a* is constituted by the diaphragm 301, second inner case 46, bellows 201 and the third inner case 200.

In this embodiment, a shaft 47 is pulled downward by the vacuum generated in the fourth diaphragm chamber 44*a*, while, in the first embodiment, the vacuum in the fourth diaphragm chamber 4*a* is negated by the first diaphragm 4 and the second diaphragm 14. However, the fourth diaphragm chamber 44*a* is always opened to the atmosphere through the orifice 304 of the pressure control valve 300, so that the vacuum established in the fourth diaphragm chamber 44*a* is as small as several mmHg at the greatest and, therefore, the influence of the vacuum is negligibly small. It will be clear to those skilled in the art that this second embodiment provides an advantageous effect equivalent to that provided by the first embodiment.

In the described embodiments, the flow rate of air introduced into the third diaphragm chamber 3*a* (43*a*) through the pressure introducing port 12 (42) is controlled in accordance with the load. This arrangement, however, is not exclusive and various changes and modifications may be imparted to the described embodiments. For instance, it is possible to control the EGR ratio in accordance with the engine speed, by controlling the flow rate of the air introduced into the third diaphragm chamber 3*a* (43*a*) by means of a solenoid valve which operates upon detect of the engine speed.

What is claimed is:

1. An exhaust gas recirculation system having: an exhaust gas control valve disposed in the exhaust gas recirculation passage providing a communication between the exhaust pipe and the intake pipe of an internal combustion engine, said exhaust gas controlling valve having an atmospheric chamber defined by a diaphragm and a case provided with an atmospheric port, a first diaphragm chamber defined by said diaphragm and a cover and adapted to receive a signal vacuum derived from the portion in the intake pipe near a throttle valve, and a valve body operatively connected to said diaphragm and adapted to open and close said exhaust gas recirculation passage; and a pressure regulating valve having a second diaphragm chamber and a third diaphragm chamber which are separated from each other by a diaphragm, said second diaphragm chamber being adapted to receive a pressure generated in an exhaust pressure controlling chamber which is defined in said exhaust gas recirculation passage immediately upstream from said valve body of said exhaust gas recirculation passage, said pressure regulating valve being adapted to regulate said signal vacuum by opening and closing the passage between said third diaphragm chamber and said first diaphragm chamber of said exhaust gas control valve; characterized by comprising inner cases disposed in said case and said cover of said exhaust gas control valve and defining said second and third diaphragm chambers of said pressure regulating valve; and a shaft connecting said valve member to said inner case defining said second diaphragm chamber, said shaft and said valve member being made hollow to provide a communication between said second diaphragm chamber and said exhaust pressure control chamber whereby said exhaust gas control valve and said pressure regulating valve being made unitary and the pressure in said third diaphragm chamber is controlled in connection with the state of operation of said engine.

2. An exhaust gas recirculation system as claimed in claim 1, characterized by further comprising a fourth diaphragm chamber, a pressure transmitting chamber through which said fourth diaphragm chamber is communicated with said third diaphragm chamber, and a pressure introducing pipe through which a pressure corresponding to the state of operation of said engine is introduced into said fourth diaphragm chamber.

3. An exhaust gas recirculation system as claimed in claim 2, wherein said fourth diaphragm chamber is defined by a pair of diaphragms.

4. An exhaust gas recirculation system as claimed in claim 2, wherein said fourth diaphragm chamber is defined by a diaphragm, a bellows and an inner case.

* * * * *

UNITED STATES PATENT AND TRADEMARK OFFICE

CERTIFICATE OF CORRECTION

PATENT NO. : 4,285,317

DATED : August 25, 1981

INVENTOR(S) : Yasuo TAKAHARA, Shigeo HAYASHI, Shizuo YAMADA & Norio SHIBATA

It is certified that error appears in the above—identified patent and that said Letters Patent is hereby corrected as shown below:

On the title page

Delete from [30] Foreign Application Priority Data

"Apr. 13, 1978 Japan.....53-49124"

Signed and Sealed this

*Thirteenth* Day of *April 1982*

[SEAL]

*Attest:*

GERALD J. MOSSINGHOFF

*Attesting Officer* *Commissioner of Patents and Trademarks*